United States Patent [19]

Amemori et al.

[11] Patent Number: 4,557,235

[45] Date of Patent: Dec. 10, 1985

[54] FUEL INJECTION QUANTITY CONTROLLING DEVICE FOR DIESEL ENGINE WITH VERTICAL CRANKSHAFT

[75] Inventors: Koichi Amemori, Takatsuki; Yosuke Takahashi, Kobe; Manabu Miyazaki, Ibaraki; Hiroaki Tsukahara, Osaka; Toshihiko Kawabe, Takatsuki; Toshio Banba, Osaka, all of Japan

[73] Assignee: Yanmar Diesel Engine Co., Ltd., Osaka, Japan

[21] Appl. No.: 557,673

[22] Filed: Dec. 2, 1983

[30] Foreign Application Priority Data

| | | | |
|---|---|---|---|
| May 16, 1983 | [JP] | Japan | 58-71675[U] |
| May 16, 1983 | [JP] | Japan | 58-71676[U] |
| May 16, 1983 | [JP] | Japan | 58-71677[U] |
| May 31, 1983 | [JP] | Japan | 58-81103[U] |
| Jun. 20, 1983 | [JP] | Japan | 58-109297 |
| Jun. 20, 1983 | [JP] | Japan | 58-109298 |
| Jun. 21, 1983 | [JP] | Japan | 58-110189 |

[51] Int. Cl.[4] ..... F02M 59/20

[52] U.S. Cl. ..... 123/367; 123/372; 123/196 W; 123/195 HC

[58] Field of Search ..... 123/373, 374, 365, 372, 123/364, 367, 182, 195 P, 343, 198 DB, 195 HC, 196 W

[56] References Cited

U.S. PATENT DOCUMENTS

| | | | |
|---|---|---|---|
| 4,036,196 | 7/1977 | Hamilton | 123/364 |
| 4,369,741 | 1/1983 | Perrin | 123/182 |
| 4,448,166 | 5/1984 | Amemori et al. | 123/90.27 |
| 4,452,194 | 6/1984 | Watanabe | 123/196 W |

*Primary Examiner*—Craig R. Feinberg
*Assistant Examiner*—David A. Okonsky
*Attorney, Agent, or Firm*—Armstrong, Nikaido, Marmelstein & Kubovcik

[57] ABSTRACT

Disclosed is a fuel injection quantity controlling device for diesel engines having a vertically extending crankshaft. The device has a control rod disposed in parallel with the crankshaft. In the event of a failure in the mechanism for vertically and reciprocatingly driving the control rod, e.g. a lever, link or the like, the control rod moves downward by the force of gravity to automatically stop the fuel supply to the unit injectors.

10 Claims, 14 Drawing Figures

FUEL INJECTION QUANTITY CONTROLLING DEVICE FOR DIESEL ENGINE WITH VERTICAL CRANKSHAFT

BACKGROUND OF THE INVENTION

The present invention relates to a device for controlling fuel injection quantity in diesel engines which are used as outboard marine engines.

In a typical diesel engine, the fuel injection device is controlled by a rotary control pinion and rack, and the quantity of injection of fuel from the fuel injection device is increased or decreased as the control pinion is rotated in one and the other directions.

This rotary control pinion, however, does not have a function of a safety device which, when a trouble has happened to take place in the diesel engine, automatically reduces the fuel injection quantity to finally stop the diesel engine.

On the other hand, in the case of diesel engine used as an outboard marine engine in which the crankshaft is disposed vertically, it is possible to lay a control rod for controlling the fuel injection quantity in parallel with the crankshaft and move the same in the vertical direction.

SUMMARY OF THE INVENTION

Accordingly, an object of the present invention is to provide a fuel injection quantity controlling device having a vertical control rod which is movable in the vertical direction, the control rod being adapted to move downward by the force of gravity when freed from the restraining force to restrict the fuel supplied to unit injectors thereby to finally stop the engine.

Another object of the invention is to improve the function, performance and maneuverability of the diesel engine, particularly diesel engine used as a marine diesel engine, by applying various improvements to every portion of the fuel injection quantity controlling device.

To these ends, the invention provides, in a diesel engine provided with a fuel injection device and provided with a vertically extending crankshaft, a fuel injection quantity controlling device comprising: a control rod for controlling the quantity of fuel injection from the fuel injection device and disposed to extend in parallel with the crankshaft, the control rod being so arranged as to cut the fuel supply to the fuel injection device when the control rod is moved by its weight in the direction of force of gravity.

In the fuel injection quantity controlling device of the invention having the described construction, when a series of connecting members for vertically and reciprocatingly moving the control rod such as lever, link and pin accidentally fail to operate, the control rod moves naturally downwardly by the force of gravity so as to cut off the fuel injection from the fuel injection device thereby to finally stop the engine.

Features and advantages of the invention will become clear from the following description of the preferred embodiments taken in conjunction with the accompanying drawings.

DESCRIPTION OF THE PREFERRED EMBODIMENTS

Figure 1:
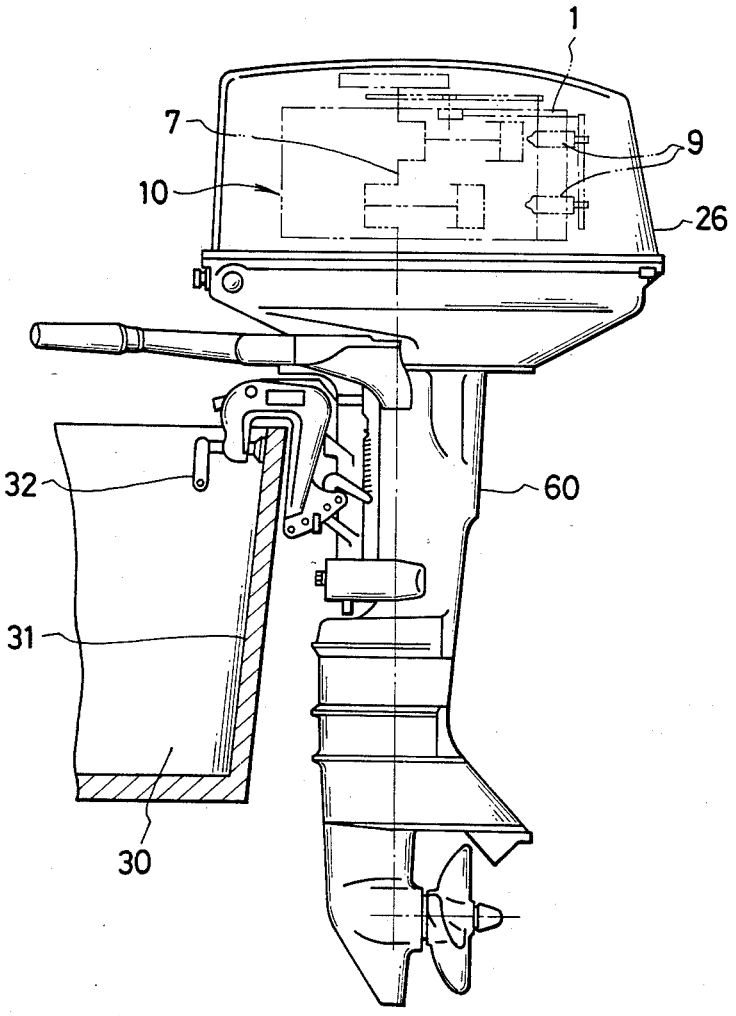
FIG. 1 is a side elevational view of an outboard marine engine equipped with a fuel injection quantity controlling device in accordance with the invention.
Figure 2:
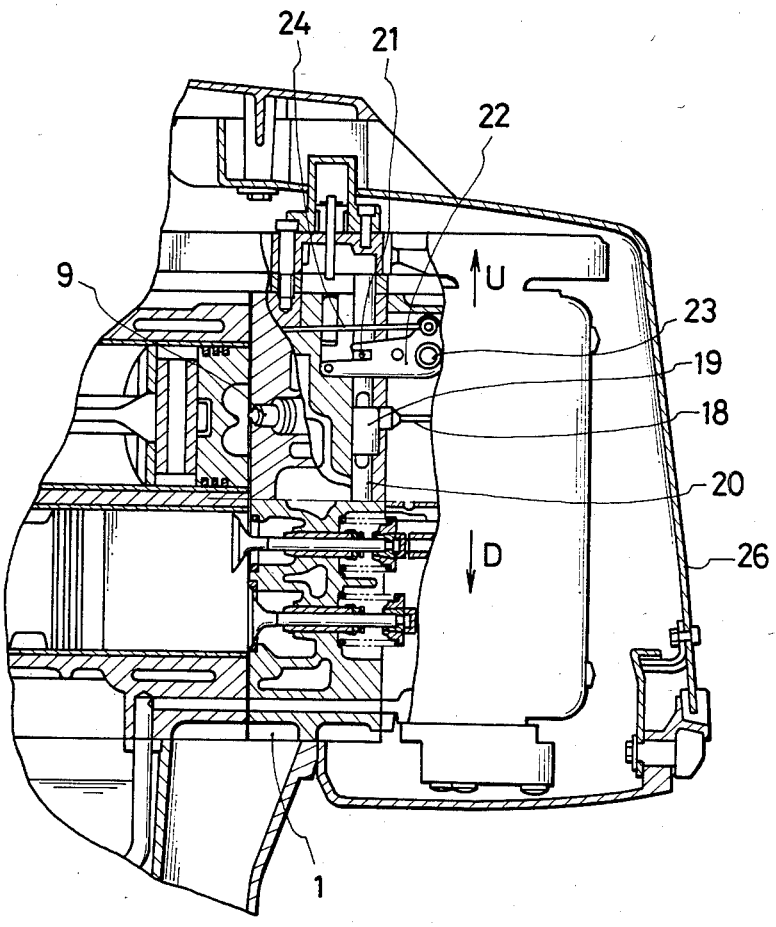
FIG. 2 is a sectional view of an essential portion of a diesel engine equipped with a fuel injection quantity controlling device of the invention.
Figure 3:
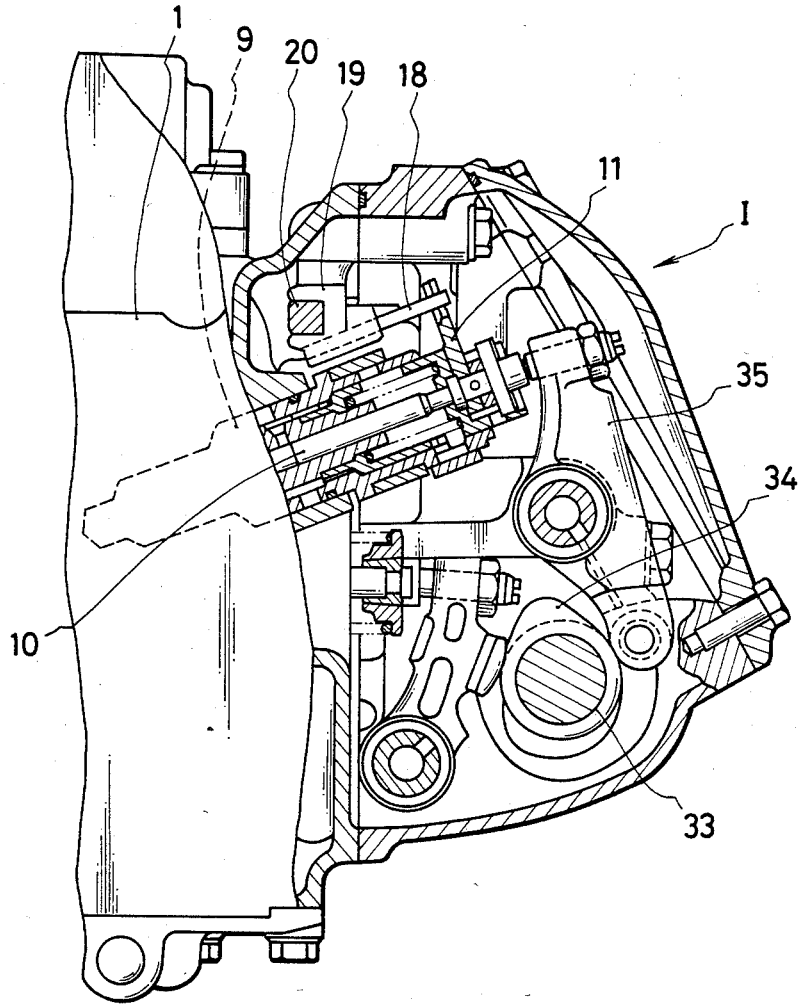
FIG. 3 is a cross-sectional view of the essential part.

FIGS. 1 to 3 in combination show a first feature of the invention. Referring to these Figures, a diesel engine 10 used as an outboard marine engine is a so-called vertical type diesel engine having a vertical crankshaft 7. More specifically, an outboard marine engine 60 has a top cowling 26 accommodating the diesel engine 10 and is secured by means of a clamp 32 to a transom 31 of a hull 30.

A so-called unit injector 9 having a fuel injection pump and an injector constructed as a unit with each other is mounted in the cylinder head 1 of the diesel engine so as to lie in a plane which intersects the crankshaft 7 at a right angle. A control lever 11 is fixed to the rear portion of the plunger of the unit injector 9. The unit injector 9 is constructed such that the fuel injection quantity is decreased and increased, respectively, as the control lever 11 is rotated clockwise and counter-clockwise as viewed in the direction of an arrow I.

A control rod 20 is disposed on the cylinder head 1 vertically, i.e. to extend in parallel with the crankshaft 7. The control rod 20 is movable reciprocatingly up and down in the longitudinal direction thereof. The control rod 20 is provided with an adjuster 19 having a pin 18 which engages with the above-mentioned control lever 11.

The arrangement is such that the fuel injection quantity is decreased and increased, respectively, as the control rod 20 moves downwardly and upwardly as indicated by arrows D and U.

The control rod 20 is provided with a pin 21 engaged by a lever 22. As the lever 22 rotates around the shaft 23, the control rod 20 moves reciprocatingly in the vertical direction. The rotation of the lever 22 is caused by a link which is operatively connected to a governor (not shown).

Thus, the control rod 20 is connected to the governor through a series of connecting members including the link 24, lever 22 and the pin 21. When the connection or fit between adjacent ones of these members is failed to disconnect these members, the control rod 20 is freed from the pulling force which has been exerted by the link 24 so that the control rod 20 moves downwardly as indicated by the arrow D due to the force of gravity. The downward movement of the control rod 20 rotates the control lever 11 clockwise to thereby cut off the fuel supply, so that the diesel engine is finally stopped automatically.

As shown in FIG. 3, the unit injector 9 is adapted to be driven by a fuel valve arm 35 which is rocked by a fuel cam 34 on the cam shaft 33.

Other embodiments of the invention will be described hereinunder with reference to the accompanying drawings.

These embodiments are to improve every portion of vertical type diesel engines having construction and function similar to those of the first embodiment shown in FIGS. 1 to 3. In the following description, same reference numerals are used to denote same parts or members.

A second feature of the invention is shown in FIG. 3. Namely, the control rod 20 mentioned above is mounted on the cylinder head 1 at a position closer to the crankshaft 7 than to the control lever 11 of the unit injector 9. According to this arrangement, the control rod 20 does not hinder the mounting or demounting of the unit injector 9 on and from the cylinder head 1, so that the mounting and demounting of the unit injector 9 is facilitated advantageously. In addition, the necessity for a readjustment of the adjuster 19 attached to the control rod 20 is eliminated.

Figure 4:
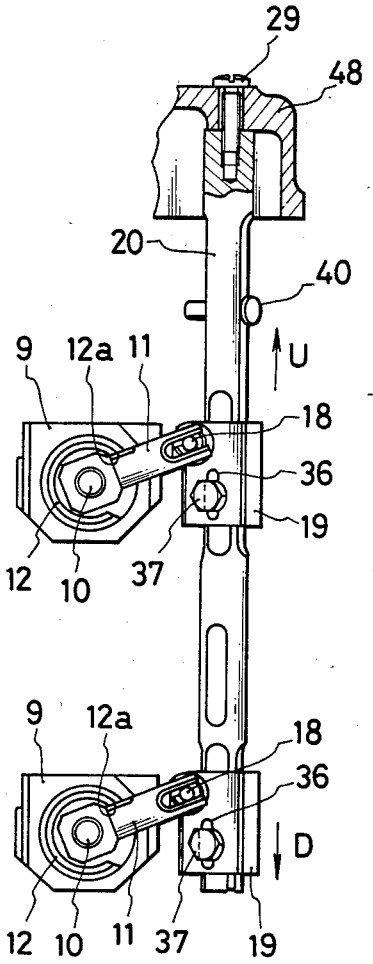
FIG. 4 is a rear elevational view of the essential part as viewed in the direction of arrow I in FIG. 3.

A third feature of the invention is shown in FIG. 4.

Usually, a coincidence in the fuel injection quantity of two unit injectors 9 mounted on a diesel engine is attained by a process comprising the steps of bringing the pin 18 of the adjuster 19 into engagement with the control lever 11, moving the adjuster 19 along the control rod 20 until the control lever 11 contacts the upper end 12*a* of the collar 12 attached to the unit injector 9, and fixing the adjuster 19 to the control rod 20 by means of a fastening bolt 37 when the control lever 11 has contacted the upper end 12*a* of each collar 12. However, any deviation of the control rod 20 in the longitudinal direction thereof or any rotation of the same around its axis makes it quite difficult to effect the adjustment for obtaining coincidence of fuel injection quantity between two unit injectors, so that much labour and time are required for such a work.

To obviate this problem, it is advisable to employ the following method. Namely, for adjusting the unit injector 9, the upper end of the control rod 20 is temporarily fixed to an idle spring mounting base 48 by means of a screw 29 which is usually used for priming or air purging from the fuel system and, thereafter, the position of the adjuster 19 is adjusted in accordance with the procedure explained before. By so doing, it is possible to easily and promptly conduct the work for obtaining coincidence of fuel injection quantities between two unit injectors 9. The adjuster 19 has an elongated hole so as to be able to move relatively to the control rod 20.

Needless to say, it is necessary to detach the screw 29 and drive the same into the air purging valve of the fuel system. If the engine is operated without placing the screw 29 in the right place, air is leaked from the air purging valve so that one can be aware of any abnormality without delay.

It is possible to use another member than the described screw 29 as means for temporarily fixing the control rod, provided that it can impede the normal operation of the engine if left attached to the control rod 20. Such member may be fixed to another portion of the control rod 20 than the upper end of the same.

Figure 5:
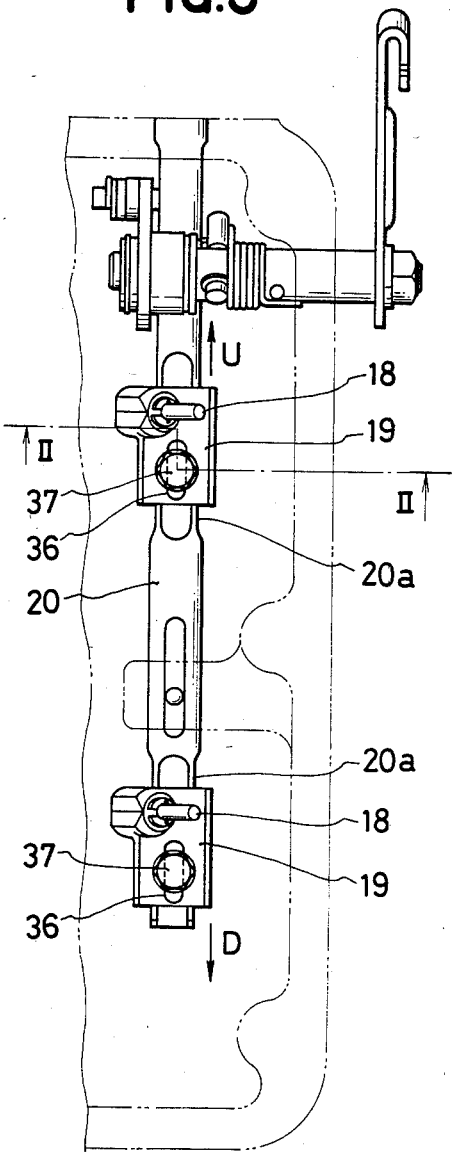
FIG. 5 is a rear elevational view of a portion around the control rod.
Figure 6:
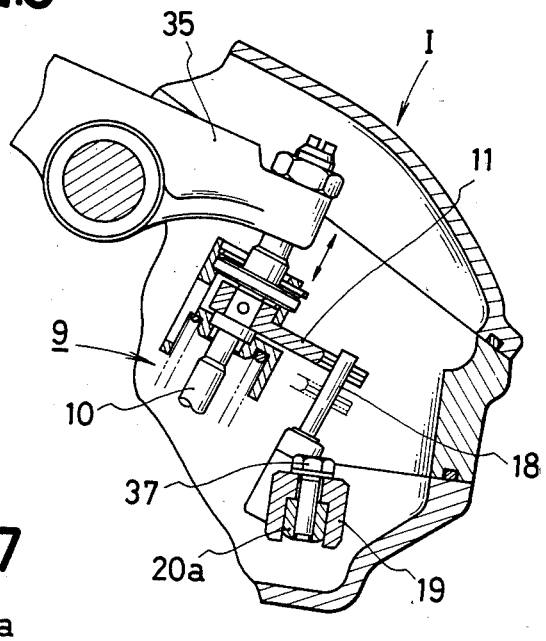
FIG. 6 is a sectional view taken along the line II—II of FIG. 5.

A fourth feature of the invention is shown in FIGS. 5 and 6. The control rod 20 has a chamfered portion 20*a* having a polygonal cross-section. On the other hand, the adjuster 19 is shaped in a form resembling a saddle or a letter U and is fitted in the direction of an arrow I so as to straddle over the portion 20*a* of the control rod 20 having the polygonal cross-section.

The adjuster 19 has an elongated hole 36 so that it can move in the longitudinal direction of the control rod 20 as the bolt 37 is loosened.

Since the adjuster 19 is mounted to straddle over the portion 20*a* of the control rod 20 having polygonal cross-section, it is possible to position the adjuster 19 simply and correctly. In addition, the work for mounting and demounting the adjuster 19 can be facilitated advantageously.

Figure 7:
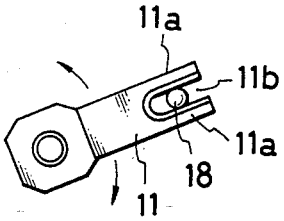
FIG. 7 is a front elevational view of an essential part of the control lever shown in FIG. 6.
Figure 8:
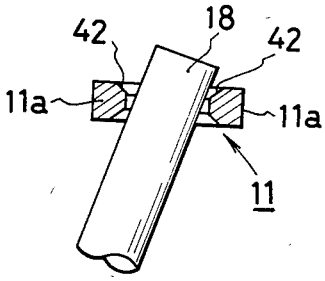
FIG. 8 is a sectional side elevational view showing how the control lever engages a pin.

A fifth feature of the invention is shown in FIGS. 7 and 8.

Figure 9:
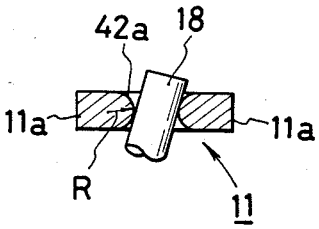
FIG. 9 is a sectional side elevational view of another embodiment showing how the control lever engages the pin.

The control lever 11 has two arms 11*a* which defines therebetween a U-shaped notch 11*b* adapted to receive the pin 18 of the adjuster 19. The arm 11 *a* is provided with an opening surface 42 slanting along the inner peripheral edge thereof. By providing this open surface 42 along the peripheral edge of the arm 11 *a*, it is possible to prevent undesirable squeezing of the pin 18 to ensure smooth engagement between the arm 11*a* and the pin 18. In addition, an opening surface 42*a* of a radius R may be formed along the inner peripheral edge of the arm 11*a* as shown in FIG. 9. Such opening surface 42*a* further ensures the prevention of undesirable squeezing of the pin 18.

Figure 10:
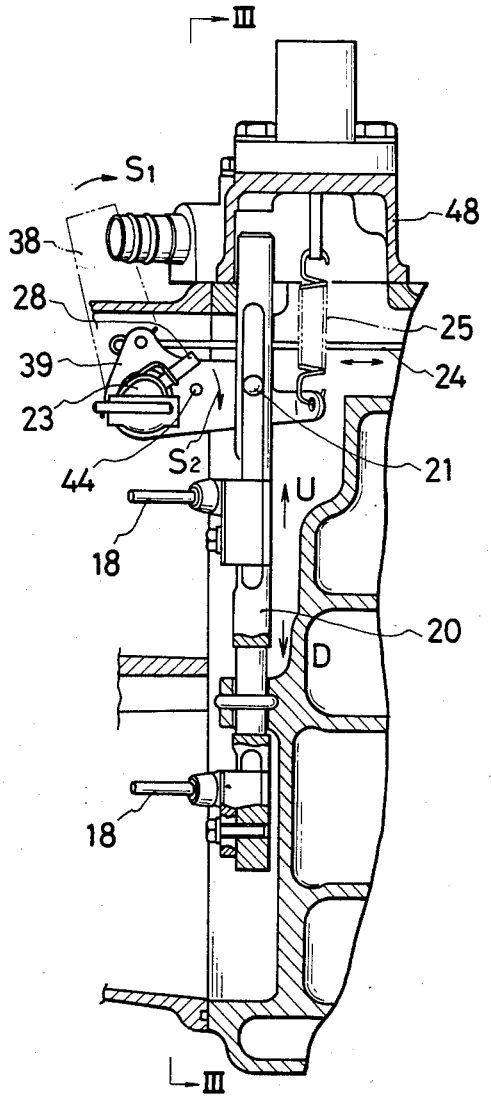
FIG. 10 is a rear elevational view of an essential portion around the control rod.
Figure 11:
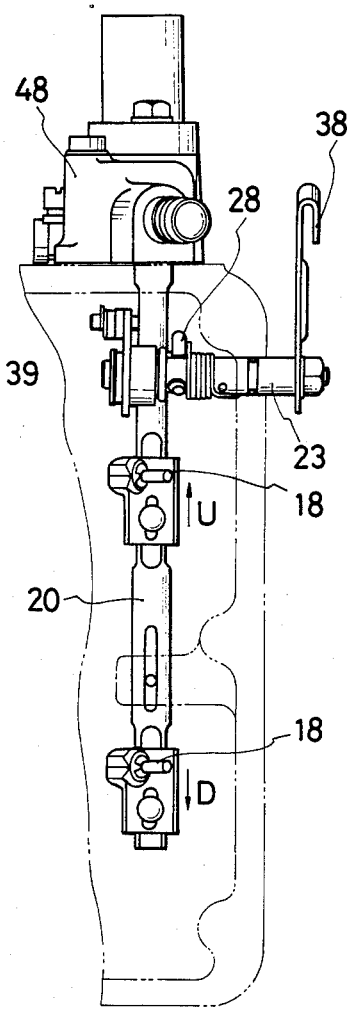
FIG. 11 is a side elevational view as viewed in the direction of arrows III—III of FIG. 10.

A sixth feature of the invention is shown in FIGS. 10 and 11. Namely, a governor device (not shown) is connected to one end of an adjusting lever 39 through a link 24, while the other end of the adjusting lever 39 is connected to an idle spring 25 mounted on an idle spring mount 48. This adjusting lever 39 is rotatably supported to one end of the supporting shaft 23 and is connected to the control rod 20 through a pin 21 fixed to the control rod 20, so that the control rod 20 moves as indicated by arrows U and D in accordance with the rotation of the adjusting lever 39.

On the other hand, a stop lever 38 is fixed to the other end of the support shaft 23 as shown in FIG. 11. Usually, the stop lever 38 takes a position as shown by two-dot-and-dash lines in FIG. 10. As the stop lever 38 is rotated in the direction of the arrow $S_1$, the pin 28 fixed to the support shaft 23 pushes a pin 44 provided on the lever 39 to thereby forcibly rotate the lever 39 in the direction of the arrow $S_1$. Consequently, the control rod 20 is slided in the direction of the arrow D.

According to this arrangement, since the stop lever 38 and the adjusting lever 39 for reciprocatingly driving the control rod 20 are carried by the common support shaft 23, it is not necessary to use independent shafts for these levers 38 and 39.

Therefore, the number of parts is decreased correspondingly and the construction for connection between the stop lever 38 and the control rod 20 can be simplified, so that the engine is made relatively light in weight and compact in size advantageously.

Figure 12:
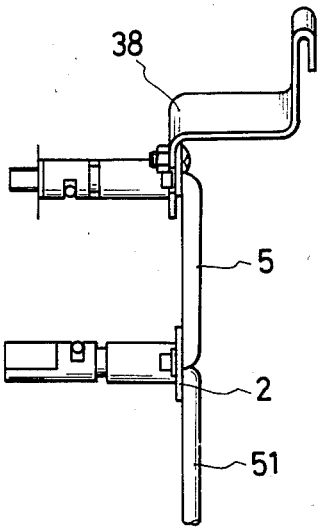
FIG. 12 is a front elevational view of a stop lever device of an engine.
Figure 13:
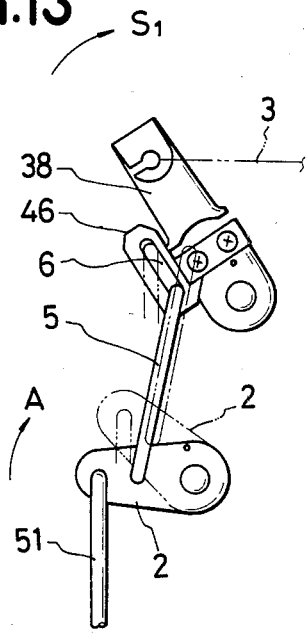
FIG. 13 is a side elevational view of the stop lever device.
Figure 14:
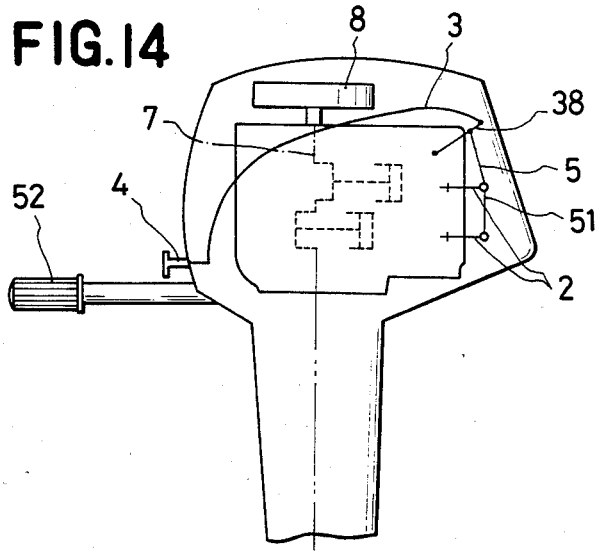
FIG. 14,is a scematic side elevational view of the stop lever device shown in FIGS. 12 and 13 applied to an outboard marine engine.

A seventh feature of the invention is shown in FIGS. 12, 13 and 14. Namely, the stop lever 38 is connected to a decompression lever 2 through a link 5 so that, as the stop lever 38 is rotated in the direction of the arrow $S_1$ to stop the engine, the decompression lever 2 is also rotated in the direction of the arrow A as indicated by two-dot-and-dash lines, thereby to slightly open the exhaust valve.

The connecting portion 46 secured to the stop lever 38 is provided with an elongated hole 6 for engaging the link 5 so that the link 5 can slide regardless of the operation of the stop lever 38 when the decompression lever 2 is operated independently.

FIG. 14 shows an outboard marine engine 60 incorporating the stop lever 38 and the decompression lever 2 linked to each other. It will be seen that two decompression levers 2 are connected to each other through a link 51.

The stop lever 38 is connected to a stop knob 4 provided near the steering handle 52 by means of a bowden wire 3.

According to this arrangement, the fuel supply to the unit injector 9 is stopped as the stop lever 38 is rotated in the direction of the arrow $S_1$ to stop the diesel engine 10. Simultaneously, the decompression lever 2 is rotated in the direction of the arrow A to slightly open the exhaust valve to allow the discharge of residual gas from the cylinder.

Therefore, no compression takes place in the cylinders when the crankshaft 7 is being rotated by the inertia of the fly-wheel 8 just before the stop of the engine, so that unfavourable vibration of the engine due to pressure rise in the cylinder is avoided advantageously.

What is claimed is:

1. In a diesel engine provided with a fuel injection device and provided with a vertically extending crankshaft, a fuel injection quantity controlling device comprising: a control rod for controlling quantity of fuel injection from said fuel injection device and disposed to extend in a vertical direction and parallel with said crankshaft, said control rod being so arranged as to cut a fuel supply to said fuel injection device when it is moved by its weight in a direction of force of gravity.

2. A fuel injection quantity controlling device for a diesel engine having a vertical crankshaft according to claim 1, wherein said fuel injection device includes a fuel injection pump and a unit injector.

3. A fuel injection quantity controlling device for a diesel engine having a vertical crankshaft according to claim 2, wherein said control rod is disposed at an opposite side of a control lever of said unit injector to a side at which said unit injector is extracted.

4. A fuel injection quantity controlling device for a diesel engine having a vertical crankshaft according to claim 2, wherein said control rod has a portion of a polygonal cross-section, and wherein an adjuster fitting said portion of polygonal cross-section has a saddle-like form, said adjuster being provided with an elongated hole so as to be able to move in a longitudinal direction of said control rod as a bolt screwed to said control rod is loosened.

5. A fuel injection quantity controlling device for a diesel engine having a vertical crankshaft according to claim 2, wherein a control lever has two arms defining therebetween a U-shaped recess receiving a pin of an adjuster, said arms having a smooth opening surface along an inner peripheral edge thereof.

6. In a diesel engine having unit injectors and a vertically extending crankshaft, a fuel injection quantity controlling device comprising: a control rod provided on a cylinder head of the engine and extending in a vertical direction parallel with said crankshaft, said control rod being reciprocatable in a longitudinal direction thereof; a plurality of adjusters attached to said control rod and each provided with a pin; and a control lever provided on the rear portion of each of said unit injectors and each engaging one of said pins; wherein said unit injectors are constructed such that a fuel injection quantity is decreased when said control lever is rotated clockwise and is increased when the control lever is rotated in a counter-clockwise direction.

7. In a diesel engine having unit injectors and a vertically extending crankshaft, a fuel injection quantity controlling device comprising: a control rod for controlling a quantity of fuel injection from said unit injectors and disposed on a cylinder head so as to extend in a vertical direction parallel with said crankshaft; an adjusting lever for sliding said control rod in a longitudinal direction of a control lever; and a stop lever for stopping said engine, said adjusting lever and said stop lever being supported by a common support shaft.

8. In a diesel engine having unit injectors and a vertically extending crankshaft, a fuel injection quantity controlling device comprising: a control rod adapted for controlling a quantity of fuel injection from said unit injectors and disposed on a cylinder head of said engine so as to extend in parallel with said crankshaft; a stop lever for sliding said control rod in the direction of a force of gravity; and a decompression lever for opening an exhaust valve, said stop lever and said decompression lever being adapted to be operatively connected to each other selectively.

9. In a diesel engine including a cylinder head provided with a fuel injection device and provided with a vertically extending crankshaft, a fuel injection quantity controlling device comprising: a control rod for controlling a quantity of fuel injection from said fuel injection device and disposed to extend in a vertical direction and parallel with said crankshaft, said control rod being so arranged as to cut a fuel supply to said fuel injection device when the control rod is moved by its weight in a direction of force of gravity, said fuel injection device including a fuel injection pump and unit injectors, said control rod being adapted to be temporarily fixed to said cylinder head during adjustment of fuel injection quantity of said unit injectors.

10. A fuel injection quantity controlling device for a diesel enging having a vertical crankshaft according to claim 9, wherein a part of said engine which makes said engine inoperative when it is left attached to said control rod is used as a fixing jig for temporarily fixing said control rod to said cylinder head.

* * * * *